US006863939B2

(12) United States Patent
Laney et al.

(10) Patent No.: US 6,863,939 B2
(45) Date of Patent: Mar. 8, 2005

(54) MICROBEAD AND IMMISCIBLE POLYMER VOIDED POLYESTER FOR INKJET IMAGING MEDIAS

(75) Inventors: Thomas M. Laney, Spencerport, NY (US); Kenneth W. Best, Jr., Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 10/326,448

(22) Filed: Dec. 20, 2002

(65) Prior Publication Data

US 2004/0121092 A1 Jun. 24, 2004

(51) Int. Cl.[7] ..... B41M 5/40

(52) U.S. Cl. ..... 428/32.16; 428/32.21; 428/32.31; 428/32.34; 428/480

(58) Field of Search ..... 428/32.16, 32.21, 428/32.31, 32.34, 480

(56) References Cited

U.S. PATENT DOCUMENTS

| | | | | |
|---|---|---|---|---|
| 4,187,113 A | | 2/1980 | Mathews et al. | 430/533 |
| 4,994,312 A | | 2/1991 | Maier et al. | 428/36.5 |
| 5,100,862 A | | 3/1992 | Harrison et al. | 503/227 |
| 5,326,391 A | | 7/1994 | Anderson et al. | 106/409 |
| 5,605,750 A | | 2/1997 | Romano et al. | 428/32.17 |
| 6,214,458 B1 | * | 4/2001 | Kobayashi et al. | 428/32.5 |
| 6,379,780 B1 | | 4/2002 | Laney et al. | 428/32.18 |
| 6,481,843 B1 | | 11/2002 | Landry-Coltrain et al. | 347/105 |

FOREIGN PATENT DOCUMENTS

| | | | | |
|---|---|---|---|---|
| EP | 0 582 750 A1 | | 2/1994 | |
| EP | 1184193 A2 | * | 3/2002 | B41M/5/00 |

* cited by examiner

*Primary Examiner*—B. Shewareged
(74) *Attorney, Agent, or Firm*—Lynne M. Blank

(57) ABSTRACT

The present invention relates to an inkjet recording element comprising a microvoided layer comprising a continuous phase polyester matrix having dispersed therein crosslinked organic microbeads and non-crosslinked polymer particles that are immiscible with the polyester matrix of said microvoided layer.

32 Claims, No Drawings

MICROBEAD AND IMMISCIBLE POLYMER VOIDED POLYESTER FOR INKJET IMAGING MEDIAS

CROSS REFERENCE TO RELATED APPLICATIONS

Reference is made to commonly assigned, co-pending U.S. patent application Ser. No. 10/326,451 by Thomas M. Laney and Teh-Ming Kung filed of even date herewith entitled "MICROBEAD AND IMMICIBLE POLYMER VOIDED POLYESTER FOR IMAGING MEDIAS"; and Ser. No. 10/324,490 by Thomas M. Laney and Teh-Ming Kung filed of even date herewith entitled "MICROBEAD AND IMMICIBLE POLYMER VOIDED POLYESTER FOR THERMAL IMAGING MEDIAS", the disclosures of which are incorporated herein.

FIELD OF THE INVENTION

The present invention relates to microbead and immiscible polymer voided films for use in inkjet imaging media.

BACKGROUND OF THE INVENTION

Recording elements or media typically comprise a substrate or a support material optionally having on at least one surface thereof an image-forming layer. The elements include those intended for reflection viewing, which usually have an opaque support, and those intended for viewing by transmitted light, which usually have a transparent support.

While a wide variety of different types of image-recording elements have been proposed, there are many unsolved problems in the art and many deficiencies in the known products which have severely limited their commercial usefulness. These deficiencies vary with the type of image recording element.

The requirements for an image-recording medium or element for ink-jet recording are very demanding. For example, the recording element should be capable of absorbing or receiving large amounts of ink applied to the image-forming surface of the element as rapidly as possible in order to produce recorded images having high optical density and good color gamut.

One example of an opaque image-recording element is described in U.S. Pat. No. 5,326,391. It consists of a layer of a microporous material which comprises a matrix consisting essentially of a substantially water-insoluble thermoplastic organic polymer, such as a linear ultra-high molecular weight polyethylene, a large proportion of finely divided water-insoluble filler of which at least 50 percent by weight is siliceous and interconnecting pores. The porous nature of the image-recording element disclosed in U.S. Pat. No. 5,326,391 allows inks to penetrate the surface of the element to produce text and/or graphic images. However, the cost of producing these elements is relatively high. Also, the image density has been found to be of poor quality, that is, the images have low optical densities and poor color gamut.

U.S. Pat. No. 5,605,750 has already addressed the latter shortcomings of image density and color gamut via the application of an upper image-forming layer. This upper image forming layer is a porous, pseudo-boehmite having average pore radius of from 10 to 80 Å. However, the high manufacturing cost of the article to form the absorbent layer is not solved in U.S. Pat. No. 5,605,750. This is due to the requirements for the porous substrate as described in U.S. Pat. No. 5,326,391.

U.S. Pat. No. 6,379,780 describes a porous substrate that may be manufactured at low cost. Further, U.S. Pat. No. 6,481,843 describes an ink jet recording element comprising the porous substrate of U.S. Pat. No. 6,379,780 including a porous image receiving layer with interconnecting voids resulting in an image recording element manufacturable at low cost and having high image quality and durability. The top porous layer of the substrate described in U.S. Pat. No. 6,379,780 and U.S. Pat. No. 6,481,843 tears apart when attempting to manufacture it as a single layered substrate. To function adequately as a support, the substrate must comprise multiple layers with a subsequent supporting layer which prevents the substrate from tearing, enabling manufacturability. This results in the need to co-extrude the substrate when manufacturing so as to include the supporting layer under the top porous layer.

It is desirable to extrude only a single layer when producing a substrate for an ink jet recording element that is porous and ink-permeable. This would enable most manufacturing machines capable of manufacturing polyester films to produce such a substrate without the need of co-extrusion capability. This is important as a relatively small number of polyester machines are capable of co-extruding. Thus, it can be seen that a need still exists in the art for the provision of an opaque image-recording element suitable for use in an inkjet printer, which is capable of recording images (including color images) having fast dry times, high optical densities and good color gamut, capable of being manufactured at a relatively low cost, and capable of being produced on existing polyester film manufacturing machines without the need of co-extrusion capability.

The use of immiscible polymer particles, such as olefins, in the polyester matrix as a void initiator has been described in U.S. Pat. No. 4,187,113. This means of voiding is very robust and results in a low cost means to void polyester. The immiscible polymer may be added simultaneously with manufacturing the substrate. Such voided layers have been shown to be manufacturable as a single layered media. However, the use of such voided polyester may not achieve open cell voids which typically enable absorbency for an ink jet imaging media. Also, the use of such voided polyester matrix layers in an ink jet imaging media has been shown to be deficient in terms of image quality. Thus the use of immiscible polymer particles does not by itself offer a solution to the problems observed with microbeads as described above.

The problem to be solved by the present invention is to formulate an opaque ink jet imaging media with a single layer substrate suitable for use in an ink-jet printer, which is capable of recording images (including color images) having fast dry times, high optical densities and good color gamut, capable of being manufactured at a relatively low cost, and capable of being produced on existing polyester film manufacturing machines without the need of co-extrusion capability.

SUMMARY OF THE INVENTION

The present invention relates to an inkjet recording element comprising a microvoided layer comprising a continuous phase polyester matrix having dispersed therein crosslinked organic microbeads and non-crosslinked polymer particles that are immiscible with the polyester matrix of said microvoided layer.

ADVANTAGEOUS EFFECT OF THE INVENTION

The present invention includes several advantages, not all of which may be incorporated in any one embodiment. In one advantage, the invention provides improved imaging medias. In another advantage, the invention provides imaging media which comprise substrates that may be manufactured as a single layer and have reduced tearability. The image recording layer can be a layer separate from the voided layer or the voided layer itself, may comprise the image recording layer. In addition, the voided layer has good absorptive ability.

DETAILED DESCRIPTION OF THE INVENTION

The invention relates to image recording elements comprising a voided polyester matrix layer. The recording element may additionally comprise an image recording layer. The voided polyester matrix layer of the element comprises a continuous phase polyester matrix having dispersed therein crosslinked organic microbeads and non-crosslinked polymer particles which are immiscible with the polyester matrix. The non-crosslinked polymer particles are immiscible with the polyester matrix to form a microvoided layer with enhanced strength and quality.

In the prior art, microvoided polyester matrix layers have been formed by using either microbeads or non-crosslinked polymer particles that are immiscible with the polyester matrix. However, when only microbeads are used, a coextruded support layer is needed to enable manufacturability without tears.

For an ink jet media application, an open cell absorbent layer is not attainable if only non-crosslinked polymer particles that are immiscible with the polyester matrix are used in the microvoided layer. Although the layers have some resistance to tear during stretching, the voided layer does not have the requisite interconnecting, open cell structure to produce a highly absorptive voided layer, which results in image recording materials having fast dry times, high optical densities and good color gamut.

In addition, microvoided polyester matrix layers formed by using microbeads have high manufacturing costs, since the beads require a complex process to manufacture and are therefore expensive and are used at high usage levels. A pre-mixing step, known as compounding, is used to introduce the microbeads into the polyester matrix prior to manufacturing the substrate. This results in a high cost to manufacture display media using substrates comprising only microbeads as the void initiators in the voided polyester matrix layer, since the high usage levels adds time and effort to the manufacturing process.

It has been unexpectedly discovered that, by mixing both crosslinked organic microbeads and the non-crosslinked polymer particles that are immiscible with the polyester matrix into the polyester matrix of the microvoided layer, the deficiencies of the void initiators when used singularly are overcome. A microvoided polyester matrix support layer can be manufactured without tears and without the need for additional support layers to avoid tears. The element also produces greatly reduced dry time, good printed image quality, ink absorbency and reduction in layer density.

The terms as used herein, "top", "upper", and "face" mean the side or toward the side of the element receiving an image. The terms "bottom", "lower side", and "back" mean the side opposite that which receives an image.

The term voids or microvoids means pores formed in an oriented polymeric film during stretching as the result of a void-initiating particle. In the present invention, these pores are initiated by either crosslinked organic microbeads or non-crosslinked polymer particles that are immiscible with the polyester matrix. The term microbead means synthesized polymeric spheres which, in the present invention, are crosslinked.

The continuous phase polyester matrix of the microvoided layer comprises any polyester and preferably comprises polyethylene(terephthalate) or a copolymer thereof. Suitable polyesters include those produced from aromatic, aliphatic, or cyclo-aliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic, and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, for example, those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol, and 1,4-cyclobexanedimethanol. Poly(ethylene terephthalate), which may be modified by small amounts of other monomers, is especially preferred. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607; 4,459,402; and 4,468,510.

The polyester matrix utilized in the invention should have a glass transition temperature from 50 degrees C. to 150 degrees C., preferably from 60 to 100 degrees C., should be orientable, and have an intrinsic viscosity of at least 0.50 centipoise (cps), preferably from 0.55 to 0.9 cps. Examples include a blend comprising polyethylene(terephthalate) and poly(1,4-cyclohexylene dimethyhlene terephthalate.

The image recording element of the present invention comprises crosslinked organic microbeads. These micro crosslinked organic microbead spheres may range in size from 0.2 to 30 micrometers. They are preferably in the range of from 0.5 to 5.0 $\mu$m. Crosslinked organic microbeads comprising a polystyrene, polyacrylate, polyallylic, or poly (methacrylate) polymer are preferred.

Preferred polymers for use in the crosslinked organic microbeads may be crosslinked and may be selected from the group consisting of alkenyl aromatic compounds having the general formula:

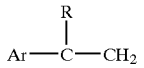

wherein Ar represents an aromatic hydrocarbon moiety, or an aromatic halohydrocarbon moiety of the benzene series and R may be hydrogen or methyl moiety, acrylate-type monomers including monomers of the formula:

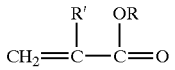

wherein R may be selected from the group consisting of hydrogen and an alkyl moiety containing from 1 to 12 carbon atoms and R' may be selected from the group consisting of hydrogen and methyl; copolymers of vinyl chloride and vinylidene chloride, acrylonitrile and vinyl chloride, vinyl bromide, vinyl esters having the formula:

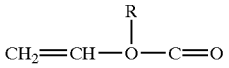

wherein R may bean alkyl group containing from 2 to 18 carbon atoms; acrylic acid, methacrylic acid, itaconic acid, citraconic acid, maleic acid, fumaric acid, oleic acid, vinylbenzoic acid; the synthetic polyester matrix resins which may be prepared by reacting terephthalic acid and dialkyl terephthalics or ester-forming derivatives thereof, with a glycol of the series $HO(CH_2)_nOH$, wherein n may be a whole number within the range of 2–10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinyl-benzene, diethylene glycol dimethacrylate, oiallyl fumarate, diallyl phthalate, and mixtures thereof.

Examples of typical monomers for making the crosslinked organic microbeads include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, trimethylol propane triacrylate. Preferably, the crosslinked polymer may be poly(butyl acrylate) or poly(methyl methacrylate). Most preferably, it is a mixture of the two, and the cross-linking agent is trimethylol propane triacrylate.

In the present invention, for the polymer to have suitable physical properties, such as resiliency, the polymer may be crosslinked. In the case of styrene crosslinked with divinylbenzene, the polymer may be from 2.5 to 50% crosslinked, preferably from 20 to 40% crosslinked. Percent crosslinked is the mol % of cross-linking agent based on the amount of primary monomer. Such limited cross-linking produces organic microbeads which are sufficiently coherent to remain intact during orientation of the continuous polymer. Crosslinked organic microbeads of such cross-linking may also be resilient, so that when they are deformed or flattened during orientation by pressure from the matrix polymer on opposite sides of the crosslinked organic microbeads, they subsequently resume their normal spherical shape to produce the largest possible voids around the crosslinked organic microbeads, thereby producing articles with less density.

The crosslinked organic microbeads may have a coating of a "slip agent". "Slip" means that the friction at the surface of the crosslinked organic microbeads is greatly reduced. Actually, it is believed this may be caused by the silica acting as miniature ball bearings at the surface. Slip agent may be formed on the surface of the crosslinked organic microbeads during their formation by including it in the suspension polymerization mix. Suitable slip agents or lubricants include colloidal silica, colloidal alumina, and metal oxides such as tin oxide and aluminum oxide. The preferred slip agents are colloidal silica and alumina, most preferably, silica. The crosslinked polymer having a coating of slip agent may be prepared by procedures well known in the art. For example, conventional suspension polymerization processes, wherein the slip agent is added to the suspension, is preferred.

The crosslinked organic microbeads coated with slip agent may be prepared by various methods. The microbeads may be prepared, for example, by a procedure in which monomer droplets containing an initiator may be sized and heated to give solid polymer spheres of the same size as the monomer droplets. In a preferred method, the polymer may be polystyrene crosslinked with divinylbenzene. The crosslinked organic microbeads may have a coating of silica. The concentration of divinylbenzene may be adjusted up or down to result in from 2.5 to 50% cross-linking by the active cross-linker, more preferably from 10 to 40% cross-linking by the active cross-linker. Of course, monomers other than styrene and divinylbenzene may be used in similar suspension polymerization processes known in the art. Also, other initiators and promoters may be used as known in the art. Slip agents other than silica may also be used. For example, a number of LUDOX® colloidal silicas are available from DuPont. LEPANDIN® colloidal alumina is available from Degussa. NALCOAG® colloidal silicas are available from Nalco, and tin oxide and titanium oxide are also available from Nalco.

Crosslinked organic microbead size may be regulated by the ratio of silica to monomer. For example, the following ratios produce the indicated size crosslinked organic microbead:

| Crosslinked Organic Microbead Size, μm | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The crosslinked organic microbeads should be dispersed into the polyester matrix prior to extruding a pre-stretched film. This may be typically accomplished using a melt compounding process utilizing a twin screw extruder. The amount of crosslinked organic microbeads present should comprise greater than 15% by weight of the microvoided layer. In a preferred embodiment, the crosslinked organic microbeads comprise from 15% to 30% by weight of the microvoided layer.

Processes well known in the art yield crosslinked organic microbeads suitable for use in the present invention. The processes known for making non-uniformly sized crosslinked organic microbeads may be characterized by broad particle size distributions and the resulting crosslinked organic beads may be classified by screening to produce beads spanning the range of the original distribution of sizes. Other processes such as suspension polymerization and limited coalescence directly yield very uniformly sized crosslinked organic microbeads. Preferably, the crosslinked organic microbeads are synthesized using the limited coalescence process. This process is described in detail in U.S. Pat. No. 3,615,972. Preparation of the coated crosslinked organic microbeads for use in the present invention does not utilize a blowing agent as described in U.S. Pat. No. 3,615,972.

"Limited coalescence" is a phenomenon wherein droplets of liquid dispersed in certain aqueous suspending media coalesce, with formation of a lesser number of larger droplets, until the growing droplets reach a certain critical and limiting size, whereupon coalescence substantially ceases. The resulting droplets of dispersed liquid, which may be as large as 0.3 and sometimes 0.5 centimeter in diameter, are quite stable, as regards further coalescence, and are remarkably uniform in size. If such a large droplet dispersion is vigorously agitated, the droplets may be fragmented into smaller droplets. The fragmented droplets, upon quiescent standing, again coalesce to the same limited degree and form the same uniform-sized, large droplet, stable dispersion. Thus, a dispersion resulting from the limited coalescence comprises droplets of substantially uniform diameter that are stable in respect to further coalescence.

The principles underlying the limited coalescence phenomenon have now been adapted to cause the occurrence of limited coalescence in a deliberate and predictable manner in the preparation of dispersions of polymerizable liquids in the form of droplets of uniform and desired size.

In the phenomenon of limited coalescence, the small particles of solid colloid tend to collect with the aqueous liquid at the liquid-liquid interface, that is, on the surface of the oil droplets. It is thought that droplets which are substantially covered by such solid colloid may be stable to coalescence while droplets which are not so covered may not be stable. In a given dispersion of a polymerizable liquid, the total surface area of the droplets is a function of the total volume of the liquid and the diameter of the droplets. Similarly, the total surface area barely coverable by the solid colloid, for example, in a layer one particle thick, is a function of the amount of the colloid and the dimensions of the particles thereof. In the dispersion as initially prepared, for example, by agitation, the total surface area of the polymerizable liquid droplets may be greater than may be covered by the solid colloid. Under quiescent conditions, the unstable droplets begin to coalesce. The coalescence results in a decrease in the number of oil droplets and a decrease in the total surface area thereof up to a point at which the amount of colloidal solid may be barely sufficient to cover the total surface of the oil droplets, whereupon coalescence substantially ceases.

If the solid colloidal particles do not have nearly identical dimensions, the average effective dimension may be estimated by statistical methods. For example, the average effective diameter of spherical particles may be computed as the square root of the average of the squares of the actual diameters of the particles in a representative sample.

It may be beneficial to treat the uniform droplet suspension prepared as described above to render the suspension stable against congregation of the oil droplets. This further stabilization may be accomplished by gently admixing an agent capable of greatly increasing the viscosity of the aqueous liquid with the uniform droplet dispersion. For this purpose, any water-soluble or water-dispersible thickening agent may be used that is insoluble in the oil droplets and that does not remove the layer of solid colloidal particles covering the surface of the oil droplets at the oil-water interface. Examples of suitable thickening agents may be sulfonated polystyrene, preferably water-dispersible, thickening grade, hydrophilic clays such as Bentonite, digested starch, natural gums, and carboxy-substituted cellulose ethers. The thickening agent may be selected and employed in such quantities as to form a thixotropic gel in which the uniform-sized droplets of the oil may be suspended. In other words, the thickened liquid generally should be non-Newtonian in its fluid behavior, that is, of a nature to prevent rapid movement of the dispersed droplets within the aqueous liquid by the action of gravitational force due to the difference in density of the phases. The stress exerted on the surrounding medium by a suspended droplet may not be sufficient to cause rapid movement of the droplet within such non-Newtonian media. Usually, the thickener agents may be employed in such proportions relative to the aqueous liquid that the apparent viscosity of the thickened aqueous liquid is in the order of at least 500 centipoise as determined by means of a Brookfield viscometer using the No. 2 spindle at 30 rpm. The thickening agent is preferably prepared as a separate concentrated aqueous composition that is then carefully blended with the oil droplet dispersion. The resulting thickened dispersion is capable of being handled, for example, passed through pipes, and may be subjected to polymerization conditions substantially without mechanical change in the size or shape of the dispersed oil droplets.

The resulting dispersions may be particularly well suited for use in continuous polymerization procedures that may be carried out in coils, tubes, and elongated vessels adapted for continuously introducing the thickened dispersions into one end and for continuously withdrawing the mass of crosslinked organic beads from the other end. The polymerization step may also be practiced in batch manner.

The order of the addition of the constituents to the polymerization usually is not critical, but it may be more convenient to add the water, dispersing agent, and incorporated oil-soluble catalyst to the monomer mixture to a vessel and subsequently add the monomer phase to the water phase with agitation.

The following general procedure may be utilized in a limited coalescence technique:

1. The polymerizable liquid is dispersed within an aqueous nonsolvent liquid medium to form a dispersion of droplets having sizes not larger than the size desired for the polymer globules, whereupon
2. The dispersion is allowed to rest and to reside with only mild or no agitation for a time during which a limited coalescence of the dispersed droplets takes place with the formation of a lesser number of larger droplets, such coalescence being limited due to the composition of the suspending medium, the size of the dispersed droplets thereby becoming remarkably uniform and of a desired magnitude, and
3. The uniform droplet dispersion is then stabilized by addition of thickening agents to the aqueous suspending medium, whereby the uniform-sized dispersed droplets are further protected against coalescence and are also retarded from concentrating in the dispersion due to difference in density of the disperse phase and continuous phase, and
4. The polymerizable liquid or oil phase in such stabilized dispersion is subjected to polymerization conditions and polymerized, whereby globules of polymer are obtained having spheroidal shape and remarkably uniform and desired size, which size is predetermined principally by the composition of the initial aqueous liquid suspending medium.

The diameter of the droplets of polymerizable liquid and, hence, the diameter of the beads of polymer, may be varied predictably, by deliberate variation of the composition of the aqueous liquid dispersion, within the range of from 0.5 $\mu$m or less to 0.5 centimeter. For any specific operation, the range of diameters of the droplets of liquid and, hence, of crosslinked organic beads, has a factor in the order of three or less as contrasted to factors of 10 or more for diameters of droplets and beads prepared by usual suspension polymerization methods employing critical agitation procedures. Since the bead size, for example, diameter, in the present method is determined principally by the composition of the aqueous dispersion, the mechanical conditions, such as the degree of agitation, the size and design of the apparatus used, and the scale of operation are not highly critical.

Furthermore, by employing the same composition, the operations may be repeated, or the scale of operations may be changed, and substantially the same results may be obtained.

One bead formation method may be carried out by dispersing one part by volume of a polymerizable liquid into at least 0.5, preferably from 0.5 to 10 or more parts by volume of a nonsolvent aqueous medium comprising water and at least the first of the following ingredients:

1. A water-dispersible, water-insoluble solid colloid, the particles of which, in aqueous dispersion, have dimensions in the order of from 0.008 to 50 $\mu$m, which particles tend to gather at the liquid-liquid interface or are caused to do so by the presence of
2. A water-soluble "promotor" that affects the "hydrophilic-hydrophobic balance" of the solid colloid particles; and/or
3. An electrolyte; and/or
4. Colloid-active modifiers such as peptizing agents, and surface-active agents; and usually,
5. A water-soluble, monomer-insoluble inhibitor of polymerization.

The water-dispersible, water-insoluble solid colloids may be inorganic materials, such as metal salts, hydroxides or clays, or may be organic materials, such as raw starches, sulfonated crosslinked organic high polymers, and resinous polymers.

The solid colloidal material should be insoluble but dispersible in water and both insoluble and nondispersible in, but wettable by, the polymerizable liquid. The solid colloids should be much more hydrophilic than oleophilic to remain dispersed wholly within the aqueous liquid. The solid colloids employed for limited coalescence are ones having particles that, in the aqueous liquid, retain a relatively rigid and discrete shape and size within the limits stated. The particles may be greatly swollen and extensively hydrated, provided that the swollen particle retains a definite shape, in which case the effective size may be approximately that of the swollen particle. The particles may be single molecules, as in the case of extremely high molecular weight crosslinked resins, or may be aggregates of many molecules. Materials that disperse in water to form true or colloidal solutions in which the particles have a size below the range stated or in which the particles may be so diffuse as to lack a discernible shape and dimension may be not suitable as stabilizers for limited coalescence. The amount of solid colloid that may be employed usually corresponds to from 0.01 to 10 or more grams per 100 cubic centimeters of the polymerizable liquid.

In order to function as a stabilizer for the limited coalescence of the polymerizable liquid droplets, it may be essential that the solid colloid should tend to collect with the aqueous liquid at the liquid-liquid interface, that is, on the surface of the oil droplets. The term "oil" may be occasionally used herein as generic to liquids that are insoluble in water. In many instances, it may be desirable to add a "promoter" material to the aqueous composition to drive the particles of the solid colloid to the liquid-liquid interface. This phenomenon is well known in the emulsion art, and is here applied to solid colloidal particles, as an expanded means of adjusting the "hydrophilic-hydrophobic balance."

Usually, the promoters are organic materials that have an affinity for the solid colloid and also for the oil droplets and that may be capable of making the solid colloid more oleophilic. The affinity for the oil surface may be due to some organic portion of the promoter molecule, while affinity for the solid colloid may be due to opposite electrical charges. For example, positively charged complex metal salts or hydroxides, such as aluminum hydroxide, may be promoted by the presence of negatively charged organic promoters such as water-soluble sulfonated polystyrenes, alignates, and carboxymethylcellulose. Negatively charged colloids, such as Bentonite, may be promoted by positively charged promoters such as tetramethyl ammonium hydroxide or chloride or water-soluble complex resinous amine condensation products, such as the water-soluble condensation products of diethanolamine and adipic acid, the water-soluble condensation products of ethylene oxide, urea and formaldehyde, and polyethylenimine. Amphoteric materials, such as proteinaceous materials like gelatin, glue, casein, albumin, or glutin, may be effective promoters for a wide variety of colloidal solids. Nonionic materials like methoxycellulose may also be effective in some instances. Usually, the promoter should be used only to the extent of a few parts per million of aqueous medium, although larger proportions may often be tolerated. In some instances, ionic materials normally classed as emulsifiers, such as soaps, long chain sulfates and sulfonates and the long chain quaternary ammonium compounds, may also be used as promoters for the solid colloids, but care should be taken to avoid causing the formation of stable colloidal emulsions of the polymerizable liquid and the aqueous liquid medium.

An effect similar to that of organic promoters may be obtained with small amounts of electrolytes, for example, water-soluble, ionizable alkalies, acids and salts, particularly those having polyvalent ions. These may be useful when the excessive hydrophilic or insufficient oleophilic characteristic of the colloid is attributable to excessive hydration of the colloid structure. For example, a suitably crosslinked sulfonated polymer of styrene may be swollen and hydrated in water. Although the molecular structure contains benzene rings which should confer on the colloid some affinity for the oil phase in the dispersion, the degree of hydration causes the colloidal particles to be enveloped in a cloud of associated water. The addition of a soluble, ionizable polyvalent cationic compound, such as an aluminum or calcium salt, to the aqueous composition may cause extensive shrinking of the swollen colloid with exudation of a part of the associated water and exposure of the organic portion of the colloid particle, thereby making the colloid more oleophilic.

The solid colloidal particles whose hydrophilic-hydrophobic balance may be such that the particles tend to gather in the aqueous phase at the oil-water interface, gather on the surface of the oil droplets, and function as protective agents during limited coalescence.

Other agents that may be employed in an already known manner to effect modification of the colloidal properties of the aqueous composition are those materials known in the art as peptizing agents, flocculating and deflocculating agents, sensitizers, and surface active agents.

It is sometimes desirable to add a few parts per million of a water-soluble, oil-insoluble inhibitor of polymerization to the aqueous liquid to prevent the polymerization of monomer molecules that might diffuse into the aqueous liquid or that might be absorbed by colloid micelles and that, if allowed to polymerize in the aqueous phase, would tend to make emulsion-type polymer dispersions instead of, or in addition to, the desired bead or pearl polymers.

The aqueous medium containing the water-dispersible solid colloid may then be admixed with the liquid polymerizable material in such a way as to disperse the liquid polymerizable material as small droplets within the aqueous medium. This dispersion may be accomplished by any usual means, for example, by mechanical stirrers or shakers, by pumping through jets, by impingement, or by other procedures causing subdivision of the polymerizable material into droplets in a continuous aqueous medium.

The degree of dispersion, for example, by agitation, is not critical, although the size of the dispersed liquid droplets should be no larger, and may be preferably much smaller, than the stable droplet size expected and desired in the stable dispersion. When such condition has been attained, the resulting dispersion may be allowed to rest with only mild, gentle movement, if any, and preferably without agitation. Under such quiescent conditions, the dispersed liquid phase undergoes a limited degree of coalescence.

The non-crosslinked polymer particles in the voided layer should be immiscible with the polyester matrix. Typical non-crosslinked polymer particles that are immiscible with the polyester matrix are olefins. The preferred olefin non-crosslinked polymer particles that are immiscible with the polyester matrix additives which may be blended with the polyester matrix are a homopolymers or copolymers of polypropylene or polyethylene. Polypropylene is preferred.

The preferred polyolefin non-crosslinked polymer particle additive used according to this invention is immiscible with the polyester matrix component of the film and exists in the form of discrete non-crosslinked polymer particles dispersed throughout the oriented and heat set film. Voiding occurs between the additive non-crosslinked polymer particles that are immiscible with the polyester matrix and the polyester matrix when the film is stretched. It has been discovered that the polymeric additive should be blended with the linear polyester matrix prior to extrusion through the film forming die by a process which results in a loosely blended mixture and does not develop an intimate bond between the polyester matrix and the polyolefin additive.

Such a blending operation preserves the incompatibility of the components and leads to voiding when the film is stretched. A process of dry blending the matrix and polyolefin additive has been found to be useful. For instance, blending may be accomplished by mixing finely divided, for example powdered or granular, polyester and polymeric additive and, thoroughly mixing them together, for example by tumbling them.

In order to form the microvoided layer in this invention, crosslinked organic microbeads should first be dispersed into a polyester matrix prior to the film forming process. This may be accomplished by feeding both the polyester matrix, in either pellet or powder form, and the crosslinked organic microbeads into a twin screw extruder. The polyester matrix may be melted and the crosslinked organic microbeads may be dispersed into the polyester melt in the twin screw extruder. The resulting extrudate may be then quenched in a water bath and then pelletized into pellets to be used in the film forming process. These pellets may be then dry blended with the polyolefin of choice, typically a polypropylene. The polyolefin may be typically in pellet form as well. Pellets of polyester may also be added to the dry blend if modifications to the volumetric loading of the crosslinked organic microbeads and the immiscible polymer are desired. The ratio of the volume of crosslinked organic microbeads used relative to the volume of the immiscible polymer used in the final blend may range from 2:3 to 3:2. The preferred ratio is 1:1.

The resulting mixture may be then fed to the film forming extruder. The extrusion, quenching and stretching of the film may be effected by any process which is known in the art for producing oriented polyester matrix film, for example by a flat film process or a bubble or tubular process. The flat film process is preferred for making film according to this invention and involves extruding the blend through a slit die and rapidly quenching the extruded web upon a chilled casting drum so that the polyester matrix component of the film may be quenched into the amorphous state. The quenched film may be then biaxially oriented by stretching in mutually perpendicular directions at a temperature above the glass-rubber transition temperature of the polyester matrix. Generally the film is stretched in one direction first and then in the second direction although stretching may be effected in both directions simultaneously if desired. In a typical process, the film is stretched firstly in the direction of extrusion over a set of rotating rollers or between two pairs of nip rollers and is then stretched in the direction transverse thereto by means of a tenter apparatus. The film may be stretched in each direction to 2.5 to 4.5 times its original dimension in the direction of stretching. The ratio of the stretching in each direction is preferably such as to form voids in the sheet with a width to length ratio of from 1:1 to 2:1. After the film has been stretched it may be heat set by heating to a temperature sufficient to crystallize the polyester matrix while restraining the film against retraction in both directions of stretching. When non-crosslinked immiscible polymer voiding agent is used in the voided layer, the voiding tends to collapse as the heat setting temperature is increased and the degree of collapse increases as the temperature increases. Hence the void volume decreases with an increase in heat setting temperatures. While heat setting temperatures up to 230° C. may be used without destroying the voids when only crosslinked organic microbeads are used in the voided layer, temperatures below 155° C. may result in a greater degree of voiding when non-crosslinked immiscible polymer voiding agent is used.

Blended polyester matrix, crosslinked organic microbeads, and immicible polymer which have been extruded and, for example, reduced to a granulated or flaked form, may be successfully re-extruded into a voided film. It may be thus possible to re-feed scrap film, for example as edge trimmings, through the process.

The size of the microvoids formed is determined by the size of the crosslinked organic microbead or non-crosslinked polymer particle that is immiscible with the polyester matrix used to initiate the void and by the stretch ratio used to stretch the oriented polymeric film. The pores may range from 0.6 to 150 $\mu$m in machine and cross machine directions of the film. They typically range from 0.2 to 30 $\mu$m in height. Preferably the height of the pores is in the range of 0.5 to 15.0 $\mu$m.

The voided volume of the voided layer should be at least 25%. A void volume of from 55% to 65% is preferred for ink jet applications with open cell voids. The density of the microvoided layer should be less than 0.95 grams/cc. The preferred range is 0.40 to 0.90 grams/cc.

Films having crosslinked organic microbead loadings in the voided layer greater than 40% by weight are open celled and absorptive thus being useful as ink jet receivers. Such films must comprise at least two layers with a supporting bottom layer along with the top voided layer. Films with at least two layers made with a supporting bottom layer and a top voided layer that contains barium sulfate loadings greater than 68% produce films that are open cell and are absorptive as well and thus are useful as ink jet receivers.

The voided layer described above, by itself, may constitute an image recording element of this invention or have adjacent image recording layers which together comprise the image recording element. The total thickness of the base may range from 20 to 400 ($\mu$m). Most applications require the base thickness to be within the range of from 30 to 300 (μm). The preferred range is from 50 to 200 (μm).

The image recording layers described above may be coated by conventional coating means commonly used in this art. Coating methods may include, but are not limited to, wound wire rod coating, knife coating, slot coating, slide hopper coating, gravure coating, spin coating, dip coating, skim-pan-air-knife coating, multilayer slide bead, doctor blade coating, gravure coating, reverse-roll coating, curtain coating, multilayer curtain coating. Some of these methods allow for simultaneous coatings of more than one layer, which may be preferred from a manufacturing economic perspective if more than one layer or type of layer needs to be applied. Known coating and drying methods are described in further detail in *Research Disclosure* No. 308119, published December 1989, pages 1007–1008. After coating, the layers are generally dried by simple evaporation, which may be accelerated by known techniques such as convection heating.

The image recording layer coating composition may be applied to one or both substrate surfaces through conventional pre-metered or post-metered coating methods listed above. The choice of coating process would be determined from the economics of the operation and, in turn, would determine the formulation specifications such as coating solids, coating viscosity, and coating speed.

One or more subbing layers may be present on top of the base used in the invention, between the base and the image recording layer used with the invention. These layers may add functionality such as antistatic properties, control colorimetry, and improve image recording layer adhesion to the base.

These layers may be coated onto the microvoided layers after the coextrusion and orienting process or between casting and full orientation. Examples of this would be acrylic coatings for printability, coating polyvinylidene chloride for heat seal properties or barrier properties. Further examples include flame, plasma or corona discharge treatment to improve printability or adhesion. In addition it may also be possible to provide either an integral layer or a separately coated layer of either an electrical conductive or charge control layer to minimized the generation of electrostatic glow or discharge of a photosensitive imaging member. In the case of a charge control layer that is either integral to another functional layer or a functional layer by itself, the charge control agents may be substantially electrically neutral to the photosensitive emulsion or its protective overcoat.

In order to improve the adhesion of the ink receiving layer to the support, an under-coating or subbing layer may be applied to the surface of the support. This layer may be an adhesive layer such as, for example, halogenated phenols, partially hydrolyzed vinyl chloride-co-vinyl acetate polymer, vinylidene chloride-methyl acrylate-itaconic acid terpolymer, a vinylidene chloride-acrylonitrile-acrylic acid terpolymer, or a glycidyl (meth)acrylate polymer or copolymer. Other chemical adhesives, such as polymers, copolymers, reactive polymers or copolymers, that exhibit good bonding between the ink receiving layer and the support may be used. The polymeric binder in the subbing layer may be preferably a water soluble or water dispersible polymer such as poly(vinyl alcohol), poly(vinyl pyrrolidone), gelatin, a cellulose ether, a poly(oxazoline), a poly(vinylacetamide), partially hydrolyzed poly(vinyl acetate/vinyl alcohol), poly(acrylic acid), poly(acrylamide), poly(alkylene oxide), a sulfonated or phosphated polyester or polystyrene, casein, zein, albumin, chitin, chitosan, dextran, pectin, a collagen derivative, collodian, agar-agar, arrowroot, guar, carrageenan, tragacanth, xanthan, rhamsan, a latex such as poly(styrene-co-butadiene), a polyurethane latex, a polyester latex, or a poly(acrylate), poly (methacrylate), poly(acrylamide) or copolymers thereof.

One preferred embodiment of this invention is an image recording element with a voided layer as described above with an ink jet recording layer adjacent to the voided layer. In this embodiment, the preferred void volume of the voided layer may be from 55% to 65%. This results in a voided layer with open cells which are preferably interconnecting, enabling absorption of liquid from inks disposed on the ink jet recording layer. Preferably, the absorbent capacity may be from 14 to 30 cc/m$^2$. The voiding should be such that the voids are preferably interconnected or open-celled. This type of structure enhances the ink absorption rate by enabling capillary action to occur.

The element may have an absorbent layer with an absorbing rate resulting in a dry time of less than 10 seconds. This dry time may be measured by printing a color line on the side of the top layer with an inkjet printer at a laydown of approximately 15 cm$^3$/m$^2$ utilizing typical inks of the following formulation:

| Ink | Water | 2-Pyrrolidone | Diethylene glycol | 1,5 Pentanediol | EHMP | Dyes |
|---|---|---|---|---|---|---|
| Cyan | 76% | 6% | ND | 8.6% | 7.7% | 1.7% |
| Magenta | 75% | 7.8% | ND | 8.5% | 7.5% | 1.2% |
| Yellow | 81% | 4.2% | 4.3% | ND | 8.2% | 1.3% |

Where: EHMP = 2-ethyl-2-(hydroxymethyl)-1,3-propanediol

This may be accomplished utilizing an HP Photo-Smart ink-jet printer using standard a HP dye-based ink cartridge (HP #C3844A & C3845A) with the printed lines running in the direction of the sheet as it is conveyed through the printer. Dry time may be measured by superposing a fresh printing paper on top of the printed line pattern immediately after printing and pressing the papers together with a roller press. If a particular printed line transfers to the surface of the fresh paper its transferred length L may be used for estimating the dry time $t_D$ using a known linear transport speed S for the printer based on the formula $$t_D = \frac{L}{S}$$

In a preferred embodiment of the invention, the ink absorbency rate results in a measured dry time of less than 1 second. The thickness of the voided layer should be such as to enable at least 14.0 cm$^3$ of ink to be absorbed per 1 m$^2$. The actual thickness may be determined by using the formula t=14.0/v where v is the void volume fraction defined as the ratio of voided thickness minus unvoided thickness to the voided thickness. The unvoided thickness is defined as the thickness that would be expected had no voiding occurred.

An ink jet recording layer may be applied to the voided layer to further enhance image quality. Such an ink jet recording layer may be porous with interconnecting voids as well. Such ink jet recording layers are described in U.S. Pat. No. 6,481,843.

Any of the above described embodiments of this invention could further be laminated to a substrate to further increase the utility of the imaging element. Typical substrates may be fabrics, paper, polymer sheets.

If desired, the microvoided layer may be disposed on a substrate such as a paper substrate. The substrate may be either transparent or opaque. Opaque substrates include plain paper, coated paper, resin-coated paper such as polyolefin-coated paper, synthetic paper, photographic paper support, melt-extrusion-coated paper, and polyolefin-laminated paper. Biaxially oriented substrates include a paper base and a biaxially oriented polyolefin sheet, typically polypropylene, laminated to one or both sides of the paper base. The substrate may also consist of microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861. Transparent substrates include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly (butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The papers listed above include a broad range of papers, from high end papers, such as photographic paper to low end papers, such as newsprint. In a preferred embodiment, Ektacolor paper made by Eastman Kodak Co. may be employed.

Used herein, the phrase "ink recording element", which may also be referred to as an "imaging element" comprises an imaging support as described above along with an image receiving or recording layer as applicable to multiple techniques governing the transfer of an image onto the imaging element. Such techniques include thermal dye transfer with thermosensitive imaging materials, electrophotographic printing, or inkjet printing, as well as a support for photographic silver halide images. As used herein, the phrase "photographic element" is a material that utilizes photosensitive silver halide in the formation of images. The element of the present invention may be used in a single technique or may be used in a hybrid system combining one or more technique. An example of a hybrid system might be an inkjet printing application on a photographic element.

Inks used to image the recording elements of the present invention are well known in the art. The ink compositions used in inkjet printing typically may be liquid compositions comprising a solvent or carrier liquid, dyes or pigments, humectants, organic solvents, detergents, thickeners, preservatives. The solvent or carrier liquid may be solely water or may be water mixed with other water-miscible solvents such as polyhydric alcohols. Inks in which organic materials such as polyhydric alcohols may be the predominant carrier or solvent liquid may also be used. Particularly useful are mixed solvents of water and polyhydric alcohols. The dyes used in such compositions may be typically water-soluble direct or acid type dyes. Such liquid compositions have been described extensively in the prior art including, for example, U.S. Pat. Nos. 4,381,946; 4,239,543; and 4,781,758, the disclosures of which are hereby incorporated by reference.

When used as inkjet imaging media, the recording elements or media typically comprise a substrate or a support material having on at least one surface thereof an ink-receiving or recording/recording or image-forming layer. If desired, in order to improve the adhesion of the inkjet receiving or recording layer to the support, the surface of the support may be corona-discharge-treated prior to applying the solvent-absorbing layer to the support or, alternatively, an undercoating, such as a layer formed from a halogenated phenol or a partially hydrolyzed vinyl chloride-vinyl acetate copolymer, may be applied to the surface of the support. The inkjet receiving or recording layer may be preferably coated onto the support layer from water or water-alcohol solutions at a dry thickness ranging from 3 to 75 micrometers, preferably 8 to 50 micrometers.

Any known inkjet receiver layer may be used in combination with other particulate materials. For example, the ink receiving or recording layer may consist primarily of inorganic oxide particles such as silicas, modified silicas, clays, aluminas, fusible beads such as beads comprised of thermoplastic or thermosetting polymers, non-fusible organic beads, or hydrophilic polymers such as naturally-occurring hydrophilic colloids and gums such as gelatin, albumin, guar, xantham, acacia, chitosan, starches and their derivatives, derivatives of natural polymers such as functionalized proteins, functionalized gums and starches, and cellulose ethers and their derivatives, and synthetic polymers such as polyvinyloxazoline, polyvinylmethyloxazoline, polyoxides, polyethers, poly (ethylene imine), poly(acrylic acid), poly(methacrylic acid), n-vinyl amides including polyacrylamide and polyvinylpyrrolidone, and poly(vinyl alcohol), its derivatives and copolymers, and combinations of these materials. Hydrophilic polymers, inorganic oxide particles, and organic beads may be present in one or more layers on the substrate and in various combinations within a layer.

A porous structure may be introduced into ink receiving or recording layers comprised of hydrophilic polymers by the addition of ceramic or hard polymeric particulates, by foaming or blowing during coating, or by inducing phase separation in the layer through introduction of non-solvent. In general, it is preferred for the base layer to be hydrophilic, but not porous. This may be especially true for photographic quality prints, in which porosity may cause a loss in gloss. In particular, the ink receiving or recording layer may consist of any hydrophilic polymer or combination of polymers with or without additives as is well known in the art.

If desired, the ink receiving or recording layer may be overcoated with an ink-permeable, anti-tack protective layer such as, for example, a layer comprising a cellulose derivative or a cationically-modified cellulose derivative or mixtures thereof. An especially preferred overcoat is poly β-1, 4-anhydro-glucose-g-oxyethylene-g-(2'-hydroxypropyl)-N, N-dimethyl-N-dodecylammonium chloride. The overcoat layer may be non porous, but may be ink permeable and serves to improve the optical density of the images printed on the element with water-based inks. The overcoat layer may also protect the ink receiving or recording layer from abrasion, smudging, and water damage. In general, this overcoat layer may be present at a dry thickness of from 0.1 to 5 μm, preferably from 0.25 to 3 μm.

In practice, various additives may be employed in the ink receiving or recording layer and overcoat. These additives include surface active agents such as surfactant(s) to improve coatability and to adjust the surface tension of the dried coating, acid or base to control the pH, antistatic agents, suspending agents, antioxidants, hardening agents to cross-link the coating, antioxidants, UV stabilizers, light stabilizers. In addition, a mordant may be added in small quantities (2%–10% by weight of the base layer) to improve waterfastness. Useful mordants are disclosed in U.S. Pat. No. 5,474,843.

The layers described above, including the ink receiving or recording layer and the overcoat layer, may be coated by conventional coating means onto a transparent or opaque support material commonly used in this art. Coating methods may include, but are not limited to, blade coating, wound wire rod coating, slot coating, slide hopper coating, gravure, curtain coating. Some of these methods allow for simultaneous coatings of both layers, which is preferred from a manufacturing economic perspective.

The IRL (ink or dye receiving layer) may be coated over a tie layer (TL). There are many known formulations, which may be useful as ink or dye receiving or recording layers. The primary requirement is that the IRL is compatible with the inks which it will be imaged so as to yield the desirable color gamut and density. As the ink drops pass through the IRL, the ink or dyes may be retained or mordanted in the IRL, while the ink solvents pass freely through the IRL and may be rapidly absorbed by the TL. Additionally, the IRL formulation may be preferably coated from water, exhibits adequate adhesion to the TL, and allows for easy control of the surface gloss.

For example, Misuda et al in U.S. Pat. Nos. 4,879,166; 5,264,275; 5,104,730; 4,879,166; and Japanese Patents 1,095,091; 2,276,671; 2,276,670; 4,267,180; 5,024,335; and 5,016,517 disclose aqueous based IRL formulations comprising mixtures of psuedo-bohemite and certain water soluble resins. Light in U.S. Pat. Nos. 4,903,040; 4,930,041; 5,084,338; 5,126,194; 5,126,195; and 5,147,717 discloses aqueous-based IRL formulations comprising mixtures of vinyl pyrrolidone polymers and certain water-dispersible and/or water-soluble polyesters, along with other polymers and addenda. Butters et al in U.S. Pat. Nos. 4,857,386 and 5,102,717 disclose ink-absorbent resin layers comprising mixtures of vinyl pyrrolidone polymers and acrylic or methacrylic polymers. Sato et al in U.S. Pat. No. 5,194,317 and Higuma et al in U.S. Pat. No. 5,059,983 disclose aqueous-coatable IRL formulations based on poly(vinyl alcohol). Iqbal in U.S. Pat. No. 5,208,092 discloses water-based IRL formulations comprising vinyl copolymers, which may be subsequently crosslinked. In addition to these examples, there may be other known or contemplated IRL formulations, which are consistent with the aforementioned primary and secondary requirements of the IRL, all of which fall under the spirit and scope of the current invention.

The IRL may also contain varying levels and sizes of matting agents for the purpose of controlling gloss, friction, and/or fingerprint resistance, surfactants to enhance surface uniformity and to adjust the surface tension of the dried coating, mordanting agents, antioxidants, UV absorbing compounds, light stabilizers.

It may also be desirable to overcoat the IRL for the purpose of enhancing the durability of the imaged element. Such overcoats may be applied to the IRL either before or after the element is imaged. For example, the IRL may be overcoated with an ink-permeable layer through which inks freely pass. Layers of this type are described in U.S. Pat. Nos. 4,686,118; 5,027,131; and 5,102,717. Alternatively, an overcoat may be added after the element is imaged. Any of the known laminating films and equipment may be used for this purpose. The inks used in the aforementioned imaging process are well known, and the ink formulations are often closely tied to the specific processes, that is, continuous, piezoelectric, or thermal. Therefore, depending on the specific ink process, the inks may contain widely differing amounts and combinations of solvents, colorants, preservatives, surfactants, humectants. Inks preferred for use in combination with the image recording elements of the present invention may be water-based. However, it is intended that alternative embodiments of the image-recording elements as described above, which may be formulated for use with inks which may be specific to a given ink-recording process or to a given commercial vendor, fall within the scope of the present invention.

The following examples are provided to illustrate the invention. They are not intended to be exhaustive of all possible variations of the invention. Parts and percentages are by weight unless otherwise indicated.

EXAMPLES

The following is an illustrative example of a possible procedure for preparing the crosslinked organic microbeads coated with slip agent. In this example, the polymer is polymethyl(methacrylate) crosslinked with divinylbenzene. The crosslinked organic microbeads have a coating of silica. The crosslinked organic microbeads may be prepared by a procedure in which monomer droplets containing an initiator may be sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX® (a colloidal suspension containing 50% silica sold by DuPont). A monomer phase is prepared by combining 3317 g methyl(methacrylate), 1421 g divinylbenzene (55% active cross-linking agent; other 45% is ethyl vinyl benzene which forms part of the methyl (methacrylate) polymer chain) and 45 g VAZO® 52 (a monomer-soluble initiator sold by DuPont). The mixture is passed through a homogenizer to obtain 5 $\mu$m droplets. The suspension is heated overnight at 52° C. to give 4.3 kg of generally spherical crosslinked organic microbeads having an average diameter of about 1.7 $\mu$m with narrow size distribution (about 1–3 $\mu$m size distribution). The mol proportion of methyl(methaerylate) and ethyl vinyl benzene to divinylbenzene is about 6.1%. The concentration of divinylbenzene may be adjusted up or down to result in about 2.5–50% (preferably 10–40%) cross-linking by the active cross-linker.

The following examples demonstrate the improvement of the invention when used as an ink jet imaging element.

Example 1–2

Layer Film, Voided Layer Made with Inorganic Voiding Agent Only (Comparative)

A 2 layer film comprising an absorbing polyester layer over a clear PET layer was prepared in the following manner. The materials used in the preparation of the voided layer were a compounded blend consisting of 31% PETG 6763 resin (IV=0.73 dl/g) (an amorphous polyester resin available from Eastman Chemical Company) and 69% of Barium Sulfate, an inorganic voiding agent, with a mean particle size of 0.8 $\mu$m for the voided layer.

The Barium Sulfate (Blanc Fixe XR from Sachtleben) was compounded with the PETG resin through mixing in a counter-rotating twin screw extruder attached to a pelletizing die forming pellets of the resin mixture. The resulting resin was dried at 65° C. Polyethylene terephthalate pellets (PET #7352 from Eastman Chemicals) were also dried but at a temperature of 150° C. Both dried materials were then melted at 275° C. and fed by plasticating screw extruders into a co-extrusion die to produce adjacent melt streams that were rapidly quenched on a chill roll after issuing from the die. By regulating the throughput of the extruders, it was possible to adjust the thickness of each layer of material in the resulting cast sheet. In this case, the thickness of the cast sheet was approx. 1000 μm. Each layer was approx. 500 μm thick. The cast sheet was first oriented in the machine direction by stretching at a ratio of 3.3 and a temperature of 110° C. This sheet was then oriented in the transverse direction in a tenter frame at a ratio of 3.3 and a temperature of 100° C. without tearing. The stretched sheet was then heat set at 150° C.

The stretched film was then cut to fit a HP 722 printer and printed using cyan, yellow, magenta, and black stripes printed utilizing the inks set forth above in the drying time test. The printed image was sharp with no significant dye migration throughout the image, and the dry time was less than 1 second. Dry time was measured by the method previously described.

Example 2

Voided Layer Made with Inorganic Voiding Agent Only (Comparative)

A single layer film comprising an absorbing polyester layer was prepared in the following manner. The materials used in the preparation of the film were a compounded blend consisting of 31% PETG 6763 resin (IV=0.73 dl/g) (an amorphous polyester resin available from Eastman Chemical Company) and 69% of Barium Sulfate, an inorganic voiding agent, with a mean particle size of 0.8 μm for the voided layer.

The Barium Sulfate (Blanc Fixe XR from Sachtleben) was compounded with the PETG resin through mixing in a counter-rotating twin screw extruder attached to a pelletizing die forming pellets of the resin mixture. The resulting resin was dried at 65° C. The resin was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 1000 μm. The cast sheet was first oriented in the machine direction by stretching at a ratio of 3.3 and a temperature of 110° C.

An attempt was then made to stretch the oriented sheet in the transverse direction at a ratio of 3.3 and a temperature of 100° C. However, the sheet continuously tore and a final stretched film was unattainable.

Example 3

Voided Layer Made with Crosslinked Organic Microbeads Only (Comparative)

A single layer film comprising an absorbing polyester layer was prepared in the following manner. The materials used in the preparation of the laminate are a compounded blend consisting of 58% by weight PETG 6763 resin (IV=0.73 dl/g) (an amorphous polyester resin available from Eastman Chemical Company) and 42% by weight crosslinked spherical poly(methyl methacrylate), (PMMA), beads 1.7 μm in diameter.

The beads were prepared by the limited coalescence method described heretofore. The beaded poly(methyl methacrylate) was compounded with the PETG resin through mixing in a counter-rotating twin screw extruder attached to a pelletizing die forming pellets of the resin mixture. The resulting resin was dried at 65° C. The resin was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 1000 μm. The cast sheet was first oriented in the machine direction by stretching at a ratio of 3.3 and a temperature of 110° C.

An attempt was then made to oriented sheet in the transverse direction in a tenter frame at a ratio of 3.3 and a temperature of 100° C. However, the sheet continuously tore and a final stretched film was unattainable.

Example 4

Voided Film Made with Non-Crosslinked Polymer Particles Immiscible with the Polyester Matrix Only (Comparative)

A single layer film comprising an absorbing polyester layer was prepared in the following manner. Polyethylene terephthalate (PET #7352 from Eastman Chemicals) was dry blended with Polypropylene("PP", Huntsman P4G2Z-073AX) at 40% weight(based on the total weight of the blend) and dried in a desiccant dryer at 65° C. for 12 hours.

The resin was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 1000 μm. The cast sheet was first oriented in the machine direction by stretching at a ratio of 3.3 and a temperature of 110° C.

An attempt was then made to oriented sheet in the transverse direction in a tenter frame at a ratio of 3.3 and a temperature of 100° C. However, the sheet continuously tore and a final stretched film was unattainable.

Example 5

Voided Layer Made with Non-crosslinked Polymer Particles Immiscible with the Polyester Matrix Only (Comparative)

A single layer film comprising an absorbing polyester layer was prepared in the following manner. Polyethylene terephthalate (PET #7352 from Eastman Chemicals) was dry blended with Polypropylene("PP", Huntsman P4G2Z-073AX) at 35% weight based on the total weight of the blend and dried in a desiccant dryer at 65° C. for 12 hours.

The resin was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 1000 μm. The cast sheet was first oriented in the machine direction by stretching at a ratio of 3.3 and a temperature of 110° C. This sheet was then oriented in the transverse direction in a tenter frame at a ratio of 3.3 and a temperature of 100° C. without tearing. The stretched sheet was then heat set at 150° C.

The stretched film was then cut to fit a HP 722 printer and printed using cyan, yellow, magenta, and black stripes printed utilizing the inks set forth above in the drying time test. The printed image was not sharp with significant dye migration throughout the image, and the dry time was greater than 5 minutes. Dry time was measured by the method described heretofore.

Example 6

Voided Layer Made with Inorganic Voiding Agent and Non-Crosslinked Polymer Particles Immiscible with the Polyester Matrix (Comparative)

A single layer film comprising an absorbing polyester layer was prepared in the following manner. Materials used in the preparation of the film were a compounded blend consisting of 31% wt PETG 6763 resin (IV=0.73 dl/g) (an amorphous polyester resin available from Eastman Chemical Company) and 69% wt of Barium Sulfate with a mean particle size of 0.8 μm for the voided layer. The Barium Sulfate (Blanc Fixe XR from Sachtleben) was compounded with the PETG resin through mixing in a counter-rotating twin screw extruder attached to a pelletizing die forming pellets of the resin mixture. Then, polyethylene terephthalate (PET #7352 from Eastman Chemicals) was dry blended with Polypropylene("PP", Huntsman P4G2Z-073AX) at 40% weight based on the total weight of the blend. This blend was then further blended with the aforementioned BaSO4/polyester pellets at a 1:1 weight ratio. This final blend was dried in a desiccant dryer at 65° C. for 12 hours.

The dried blend was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 1000 μm. The cast sheet was first oriented in the machine direction by stretching at a ratio of 3.3 and a temperature of 110° C. The sheet was then oriented in the transverse direction in a tenter frame at a ratio of 3.3 and a temperature of 100° C. The stretched sheet was then heat set at 150° C.

The stretched film was cut to fit a HP 722 printer and printed using cyan, yellow, magenta, and black stripes printed utilizing the inks set forth above in the drying time test. The printed image was not sharp with significant dye migration throughout the image, and the dry time was greater than 5 minutes. Dry time was measured by the method previously described.

Example 7

Invention

A single layer film comprising an absorbing polyester matrix layer was prepared in the following manner. Materials used in the preparation of the film were a compounded blend consisting of 58% by weight PETG 6763 resin (IV=0.73 dl/g) (an amorphous polyester resin available from Eastman Chemical Company) and 42% by weight crosslinked spherical poly(methyl methacrylate) beads 1.7 μm in diameter. The crosslinked organic beads were prepared by the limited coalescence method described heretofore. The beaded poly(methyl methacrylate) was compounded with the PETG resin through mixing in a counter-rotating twin screw extruder attached to a pelletizing die forming pellets of the resin mixture. Then, polyethylene terephthalate (PET #7352 from Eastman Chemicals) was dry blended with Polypropylene("PP", Huntsman P4G2Z-073AX) at 40% weight(based on the total weight of the blend). This blend was then further blended with the aforementioned PMMA/polyester pellets at a 1:1 weight ratio. This final blend was dried in a desiccant dryer at 65° C. for 12 hours.

The dried blend was then melted at 275° C. and fed by a plasticating screw extruder into an extrusion die manifold to produce a melt stream which was rapidly quenched on a chill roll after issuing from the die. By regulating the throughput of the extruder, it was possible to adjust the thickness of the resulting cast sheet. In this case the thickness of the cast sheet was approx. 1000 μm. The cast sheet was first oriented in the machine direction by stretching at a ratio of 3.3 and a temperature of 110° C. The sheet was then oriented in the transverse direction in a tenter frame at a ratio of 3.3 and a temperature of 100° C. The stretched sheet was then heat set at 150° C.

The stretched film was then cut to fit a HP 722 printer and printed using cyan, yellow, magenta, and black stripes printed utilizing the inks set forth above in the drying time test. The printed image was sharp with no significant dye migration throughout the image, and the dry time was less than 1 second. Dry time was measured by the method previously described.

Table 1 gives a description of examples 1 through 10 and includes a rating of tearability of the films during processing.

TABLE 1

| SAMPLE | DESCRIPTION | TEARABILITY |
|---|---|---|
| Example 1 (Comparative) | (2 layer) 69% BASO4 in Polyester/PET | GOOD |
| Example 2 (Comparative) | (1 layer) 69% BASO4 in Polyester | V. POOR |
| Example 3 (Comparative) | (1 layer) 42% PMMA in Polyester | V. POOR |
| Example 4 (Comparative) | (1 layer) 40% PP in Polyester | POOR |
| Example 5 (Comparative) | (1 layer) 35% PP in Polyester | GOOD |
| Example 6 (Comparative) | (1 layer) 1:1 blend Ex. 1 & 4 | GOOD |
| Example 7 (Invention) | (1 layer) 1:1 blend Ex. 4 & 3 | GOOD |

• - data represents the voided layer only

The data in Table 1 illustrate the ability of the present invention to produce a single voided layer with reduced tearability, thus allowing the production of a single voided layer. The prior art voided layers utilizing voiding particles, such as microbeads, while able to be stretched in multi-layer format, tore apart when stretched in single layer, as illustrated by Examples 1 and 2. Polymeric particles immiscible with polyester matrix were sometimes, but not always, able to survive single layer stretching, as illustrated by Examples 4 and 5. Surprisingly, the present invention, Example 7, illustrates that the combination of immiscible polymeric particle having variable tearability characteristics with the cross-linked organic microbead having poor tearability characteristics produces a voided layer with good tearability, a synergistic result, not additive of the combination. From the examples in Table 1, it may be seen that the combination of crosslinked organic microbeads and non-crosslinked polymer particles immiscible with the polyester matrix, in this case polypropylene, enables the production of a single layer ink jet imaging element that doesn't tear when performing the transverse stretch.

TABLE 2

| SAMPLE | DESCRIPTION | THICK. (um's) | DENSITY (gm/cc) | VOID VOL.(%) |
|---|---|---|---|---|
| Example 2 (Comparative) | (1 layer) 69% BASO4 in Polyester | NA | NA | NA |
| Example 3 (Comparative) | (1 layer) 42% PMMA in Polyester | NA | NA | NA |
| Example 4 (Comparative) | (1 layer) 40% PP in Polyester | NA | NA | NA |
| Example 5 (Comparative) | (1 layer) 35% PP in Polyester | 204 | 0.56 | 50.6 |
| Example 6 (Comparative) | (1 layer) 1:1 blend Ex. 4 & 1 | 219 | 0.71 | 54.6 |
| Example 7 (Invention) | (1 layer) 1:1 blend Ex. 4 & 3 | 249 | 0.49 | 60.5 |

• - data represents the voided layer only

Table 2 illustrates the surprising improvement in void volume, which impacts absorbency and dry time, and density reduction. Tearability is also illustrated in this Table, since Examples 2, 3, both produced with voiding particles, and 4, produced with immiscible polymeric particles, were unable to be stretched and voided. Of the samples that did not tear during stretching, Inventive Example 7 demonstrate the highest void volume. Again, a synergistic result occurs, since the void volume of a combination of crosslinked organic microbeads with non-crosslinked polymeric particles immiscible in the polyester matrix produces a voided layer with a void volume greater than either voiding volume alone. Also, Inventive Example 7 demonstrates a synergistic effect on density reduction. Inventive Example 7 has a density much lower than the densities of either of the Comparison Examples 5 and 6. From the examples in Table 2, it may be seen that the combination of crosslinked organic microbeads and non-crosslinked polymer particles immiscible with the polyester matrix produces a void volume greater than 55%, enabling ink absorbency and good printed image quality, while demonstrating a reduction in density.

TABLE 3

| SAMPLE | DESCRIPTION | DRY TIME | IMAGE QUALITY |
|---|---|---|---|
| Example 2 (Comparative) | (1 layer) 69% BASO4 in Polyester | NA | NA |
| Example 3 (Comparative) | (1 layer) 42% PMMA in Polyester | NA | NA |

TABLE 3-continued

| SAMPLE | DESCRIPTION | DRY TIME | IMAGE QUALITY |
|---|---|---|---|
| Example 4 (Comparative) | (1 layer) 40% PP in Polyester | NA | NA |
| Example 5 (Comparative) | (1 layer) 35% PP in Polyester | >5 min. | V. POOR |
| Example 6 (Comparative) | (1 layer) 1:1 blend Ex. 1 & 4 | >5 min. | V. POOR |
| Example 7 (Invention) | (1 layer) 1:1 blend Ex. 4 & 3 | <1 sec | GOOD |

• - data represents the voided layer only

Table 3 illustrates the improved dry time achieved with the voided layer of the present invention. From the examples in Table 3, it may be seen that the combination of crosslinked organic microbeads and non-crosslinked polymer particles immiscible with the polyester matrix enables the production of a single layer ink jet imaging element with greatly reduced dry time, as compared to Examples 5 and 6, and good printed image quality.

What is claimed is:

1. An inkjet recording element comprising a microvoided film comprising a continuous phase polyester matrix having dispersed therein crosslinked organic microbeads and non-crosslinked polymer particles that are immiscible with the polyester matrix of said microvoided film.

2. The element of claim 1 wherein the microvoided film has a void volume of from 55 to 65 volume %.

3. The element of claim 1 wherein said continuous phase polyester of said microvoided film comprises polyethylene (terephthalate) or a copolymer thereof.

4. The element of claim 1 wherein said continuous phase polyester of said microvoided film comprises a blend comprising polyethylene(terephthalate) and poly(1,4-cyclohexylene dimethyhlene terephthalate).

5. The element of claim 1 wherein said crosslinked organic microbeads comprise at least one of styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethyl-propane sulfonic acid, vinyl toluene, trimethylol propane triacrylate.

6. The element of claim 1 wherein said crosslinked organic microbead comprise a poly(methyl methacrylate) or poly(butyl acrylate) polymer.

7. The element of claim 1 wherein said crosslinked organic microbead comprises greater than 15% by weight of said microvoided film.

8. The element of claim 1 wherein said crosslinked organic microbead comprises from 15% to 30% by weight of said microvoided film.

9. The element of claim 1 wherein said non-crosslinked polymer particles that are immiscible with the polyester matrix have an olefinic backbone.

10. The element of claim 9 wherein said non-crosslinked polymer particles that are immiscible with the polyester matrix comprise polymers derived from a monomer selected from propylene or ethylene.

11. The element of claim 9 wherein said polyolefin comprises polypropylene.

12. The element of claim 1 wherein said microvoided film has a density of less than 0.95 grams/cc.

13. The element of claim 1 wherein said microvoided film has a density of from 0.4 to 0.90 grams/cc.

14. The element of claim 1 wherein the total thickness of said microvoided film is from 20 to 400 micrometers.

15. The element of claim 1 wherein the total thickness of said microvoided film is from 30 to 300 micrometers.

16. The element of claim 1 wherein the total thickness of said microvoided film is from 50 to 200 micrometers.

17. The element of claim 1 wherein the absorbent capacity comprises from 14 to 30 $cc/m^2$.

18. The element of claim 1 wherein said element has a dry time of less than 10 seconds.

19. The element of claim 1 wherein said element has a dry time of less than 1 second.

20. The element of claim 1 wherein the microvoided film has interconnecting voids.

21. The element of claim 1 wherein the ratio of the volume of crosslinked microbeads to the volume of non-crosslinked polymer particles that are immiscible with the polyester matrix is from 3:2 to 2:3.

22. The element of claim 1 wherein the ratio of the volume of crosslinked microbeads to the volume of non-crosslinked polymer particles that are immiscible with the polyester matrix is 1:1.

23. The element of claim 1 further comprising an image recording layer disposed on at least 1 surface of said microvoided film wherein said image recording layer comprises an inkjet receiving layer.

24. The element of claim 23 wherein said inkjet receiving layer is porous having interconnecting voids.

25. The element of claim 23 further comprising one or more subbing layers are present between said image recording layer and said microvoided film.

26. The element of claim 1 wherein said element is laminated to a substrate.

27. The element of claim 26 wherein said substrate comprises fabric.

28. The element of claim 26 wherein said substrate comprises paper.

29. The element of claim 26 wherein said substrate comprises a polymer sheet.

30. The element of claim 29 wherein said polymer sheet is voided.

31. The element of claim 29 wherein said polymer sheet is oriented.

32. An inkjet recording element comprising a microvoided film comprising a continuous phase polyester matrix having dispersed therein crosslinked organic microbeads and non-crosslinked polymer particles that are immiscible with the polyester matrix of said microvoided film and further comprising an image recording layer disposed on at least 1 surface of said microvoided film wherein said image recording layer comprises an inkjet receiving layer.

* * * * *